US006581379B2

(12) United States Patent
Nomura et al.

(10) Patent No.: US 6,581,379 B2
(45) Date of Patent: Jun. 24, 2003

(54) PRESSURE INTENSIFYING APPARATUS FOR HYDRAULIC CYLINDER

(75) Inventors: Kazushi Nomura, Tokyo (JP); Hiroshi Kitamura, Tokyo (JP); Satoshi Komatsu, Tokyo (JP)

(73) Assignee: Nambu Co., Ltd., Tokyo (JP)

( * ) Notice: Subject to any disclaimer, the term of this patent is extended or adjusted under 35 U.S.C. 154(b) by 57 days.

(21) Appl. No.: 09/948,539

(22) Filed: Sep. 10, 2001

(65) Prior Publication Data

US 2002/0029569 A1 Mar. 14, 2002

(30) Foreign Application Priority Data

Sep. 11, 2000 (JP) ..... 2000-275041

(51) Int. Cl.[7] ..... F15B 7/00
(52) U.S. Cl. ..... 60/563
(58) Field of Search ..... 60/563, 405, 407

(56) References Cited

U.S. PATENT DOCUMENTS 1,888,990 A * 11/1932 Kurath ..... 60/563
3,945,206 A 3/1976 Krause
4,208,879 A * 6/1980 Segawa ..... 60/563
4,864,914 A * 9/1989 LeMoine ..... 60/563
4,924,671 A 5/1990 Reinert
4,955,195 A * 9/1990 Jones et al. ..... 60/405
5,207,267 A 5/1993 Iwamoto et al.
5,622,217 A 4/1997 Iwamoto et al.

* cited by examiner

*Primary Examiner*—Edward K. Look
*Assistant Examiner*—Igor Kershteyn
(74) *Attorney, Agent, or Firm*—Sughrue Mion, PLLC

(57) ABSTRACT

There are provided a pressure intensifying cylinder 2*a* for allowing a pressure intensifying chamber 31 to communicate with a head-side cylinder chamber 22 of a working cylinder 1 and its control hydraulic circuit. When a load and a rated pressure Pp of a hydraulic pump 25 are balanced with each other at the time of inserting and setting a core 41, a check valve 21 is closed and a sequence valve 34 is opened to move the pressure intensifying cylinder 2*a* forward, so that the pressure of the head-side cylinder chamber 22 is increased. A pressure intensifying ratio of the pressure intensifying cylinder 2*a* is set such that the pressure of the head-side cylinder chamber 22 is higher than pressure occurring with molding pressure.

5 Claims, 9 Drawing Sheets

PRESSURE INTENSIFYING APPARATUS FOR HYDRAULIC CYLINDER

BACKGROUND OF THE INVENTION

1. Field of the Invention

The present invention relates to a pressure intensifying apparatus for a hydraulic cylinder, and, more particularly, to an apparatus which is adapted for use for a core driving cylinder in a die cast machine or an injection molding machine and deals with the phenomenon that a hydraulic fluid is compressed to push the core back at the time of casting or applying pressure.

2. Description of the Related Art

A die cast machine employs a casting scheme of injecting a molten metal or semimolten alloy to which a molding pressure is applied by an injection cylinder into a cavity whose shape corresponds to the shape of a product and which is formed by assembling a movable mold and the core to a fixed mold, via a runner. The pressure molding can provide castings of relatively complicated shapes with high precision.

The conventional core driving hydraulic cylinders usually use a hydraulic circuit as shown in FIG. 10.

Referring to the diagram, a hydraulic cylinder 200 comprises a cylinder tube 201, a rod cover 202, a head cover 203, a piston 204 and a rod 205. A 4-port, 3-position switching valve 210 allows the supply and discharge of a hydraulic fluid to and from a rod-side port 206 and a head-side port 207 via meter-in circuits 208 and 209. The hydraulic cylinder 200 is designed in such a manner that a core 211 attached to the piston rod 204, 205 is fitted in and pulled out from a predetermined hole or the like, which is formed in a mold, in the advancing/reversing step. A pilot check valve 212 is disposed between the head-side port 207 of the hydraulic cylinder 200 and the meter-in circuit 209, and its pilot pressure comes from the rod-side port 206.

With the structures of the hydraulic cylinder 200 and the hydraulic circuit, first, the switching valve 210 is set to the state shown in FIG. 10, and then the hydraulic fluid is supplied from the head-side port 207 to move the piston rod 204, 205 forward from the backward limit. This causes the core 211 to enter the mold to a predetermined position. When the core 211 reaches the insertion limit, the pressure of a head-side cylinder chamber 213 of the hydraulic cylinder 200 becomes the rated pressure of a hydraulic pump 214. With the pressure balanced, the piston 204 stops, closing the open pilot check valve 212.

As a result, the head-side cylinder chamber 213 of the hydraulic cylinder 200 is sealed tightly and the piston rod 204, 205 is locked. Then, a molten metal is injected into the cavity under high pressure (molding pressure) and is left in that state for solidification, which completes casting.

When casting is completed, the switching valve 210 is switched to the opposite supply and discharge position, and the hydraulic fluid is supplied from the rod-side port 206 to move the piston rod 204, 205 backward. In this case, the pilot pressure acts on the pilot check valve 212 to open the closed valve 212, and the piston rod 204, 205 returns to the original backward limit.

Thereafter, the cavity is opened for removal of the casting.

When a molten metal is injected into the cavity with the core 211 pressed into the mold to its positional limit, the molding pressure of the molten metal is applied to the core 211 and the force FL equivalent to the molding pressure × the pressure receiving area acts on the core 211. This applies a large push-back load on the piston rod 204, 205 of the hydraulic cylinder 200.

In this case, as the pilot check valve 212 is closed, the piston rod 204, 205 is held locked. The generation of such a push-back load normally raise no problems. Because the load is generally intensive reactive force, which is several times the rated pressure of the hydraulic pump 214, however, a very large pressure is applied to the hydraulic fluid in the head-side cylinder chamber 213.

Specifically, the pressure of the hydraulic fluid becomes $PLa=FL/Ah$ where FL is the push-back load on the core 211 and Ah is the pressure receiving area of the piston 204. Given that the rated pressure of the hydraulic pump 214 is Pp, the pressure of the hydraulic fluid increases by $\Delta Pa=PLa-Pp$ after the core 211 is moved forward to the positional limit and the pilot check valve 212 is closed.

The hydraulic fluid is not a complete incompressive fluid, but has a compressibility, very small though it is.

Accordingly, given that the volume of the head-side cylinder chamber 213 is Va and the compressibility of the hydraulic fluid is $\beta$, the hydraulic fluid is compressed by $\Delta V=\Delta Pa\times Va\times\beta$, with the result that the piston rod 204, 205 is pushed back by $(\Delta V/Ah)$.

The push-back quantity is naturally decided depending on the conditions of the respective elements relating to the aforementioned equation. In actuality, the quantity is of such magnitude that it may be almost ignored with respect to the process length of the normal hydraulic cylinder since the compressibility of the hydraulic fluid: $\beta$ is low.

However, in recent years, high accuracy of dimension has been required of die cast products, and products having no secondary operation needed are often demanded of auto-parts, parts for electric equipment, and the like, and an error in size caused by the aforementioned push-back cannot be ignored in some cases.

As measures against the above problem, there is a case in which a mold and the like are designed in consideration of the above-mentioned error beforehand. The specification of the hydraulic cylinder adapted to the die cast machine is not uniformly provided, a case in which the change in the specification is made must be assumed, and the above measures are unrealistic in view of the point that the aforementioned error changes depending on the condition of the hydraulic cylinder.

It is an object of the present invention is to provide an apparatus wherein a small-sized pressure intensifying cylinder designed rationally is additionally provided to a working cylinder is added and the pressure intensifying cylinder is controlled adaptively in an advancing step or reversing step, whereby solving the aforementioned problem.

SUMMARY OF THE INVENTION

The first invention relates to a pressure intensifying apparatus for a hydraulic cylinder comprising: a working cylinder; a pressure intensifying cylinder for allowing a pressure intensifying chamber to communicate with a head-side cylinder chamber of the working cylinder; a switching valve for controlling supply and discharge of a hydraulic fluid with respect to a head-side port and a rod-side port of the working cylinder; a first pilot check valve which is disposed in a head-side supply and discharge circuit for connecting the head-side port of the working cylinder to the switching valve and whose pilot pressure is a pressure of a rod-side supply and discharge circuit for connecting the rod-side port of the working cylinder to the switching valve; a check-valve equipped sequence valve which is disposed in a connection circuit for connecting a drive chamber side of the pressure intensifying cylinder to a portion of the head-side supply and discharge circuit closer to the switching valve than the first pilot check valve, and switches from a closed state to an open state with a rated pressure of a hydraulic pump for supplying the hydraulic fluid to the head-side supply and discharge circuit via the switching valve; and a second pilot check valve whose pilot pressure is the pressure of the rod-side supply and discharge circuit, the working cylinder, the pressure intensifying cylinder, the switching valve, the first pilot check valve, the check-valve equipped sequence valve and the second pilot check valve being connected in series in such a way as to satisfy $K>PLa/Pp$ where K is a pressure intensifying ratio of the pressure intensifying cylinder, Pp is the rated pressure of the hydraulic pump and PLa is a pressure in the head-side cylinder chamber when a maximum load occurring after Pp is balanced with a load acting on a piston rod of the working cylinder in a piston-rod advancing step of the working cylinder is applied, and $\Delta V=(PLa-Pp)\times Va\times\beta$ where $\Delta V$ is a maximum discharge volume of the pressure intensifying chamber of the pressure intensifying cylinder, Va is a volume of the head-side cylinder chamber when balance is held and $\beta$ is a compressibility of the hydraulic fluid.

According to this invention, when the rated pressure of the hydraulic pump and the load acting on the piston rod are balanced with each other in the advancing step of the piston rod of the working cylinder, the first pilot check valve is switched from the open state to the close state, and the check-valve equipped sequence valve and the second pilot check valve is switched from the close state to the open state, so that the pressure intensifying cylinder is automatically advanced.

The pressure intensifying ratio of the pressure intensifying cylinder: K is set to a value that gives the advancing force, which exceeds the maximum load of the push-back acting on the piston rod after the balance is held, to the piston rod based on the condition of $K>PLa/Pp$. Also, the maximum discharge volume of the pressure intensifying chamber: $\Delta V$ is set to a value that compensates for the compression quantity of the hydraulic fluid of the head-side cylinder chamber based on the condition of $\Delta V-(PLb-Pp)\times Vb\times\beta$.

The reason why (PLa−Pp) is given is as follows:

More specifically, since the hydraulic fluid is compressed with Pp in advance, a necessary compensation quantity is only the compression quantity corresponding to (PLa−Pp), which is equivalent to an increase in pressure.

Accordingly, after the state where balance is held, only the hydraulic fluid, which is equivalent to the compression quantity, is supplied to the head-side cylinder chamber in such a way that the pressure of the cylinder chamber is automatically increased to be higher than PLa. For this reason, the piston rod is locked at a predetermined position without being pushed back by the compression of the hydraulic fluid.

According to this invention, the supply and discharge control for the working cylinder and the pressure intensifying cylinder can be performed by a single switch valve.

The above pressure intensifying apparatus relates to the case in which the working cylinder receives the load in the piston rod advancing step. In the case of opposing to the maximum load occurring in the reversing step, the pressure intensifying chamber of the pressure intensifying cylinder is made to communicate with the rod-side cylinder chamber of the working cylinder, and the other conditions relating to the arrangement of hydraulic circuit and the pressure intensifying cylinder may be provided in reverse at the head side and the rod side.

The second invention relates to a pressure intensifying apparatus for a hydraulic cylinder comprising: a working cylinder; a pressure intensifying cylinder for allowing a pressure intensifying chamber to communicate with a head-side cylinder chamber of the working cylinder; a switching valve for controlling supply and discharge of a hydraulic fluid with respect to a head-side port and a rod-side port of the working cylinder; a pilot check valve which is disposed in a head-side supply and discharge circuit for connecting the head-side port of the working cylinder to the switching valve and whose pilot pressure is a pressure of a rod-side supply and discharge circuit for connecting the rod-side port of the working cylinder to the switching valve; a pressure sensor for detecting a pressure in the head-side cylinder chamber of the working cylinder; and pressure intensification control means for controlling supply and discharge of the hydraulic fluid to and from a drive chamber of the pressure intensifying cylinder using a detection signal from the pressure sensor in a piston-rod advancing step of the working cylinder, wherein $K>PLa/Pp$ is satisfied where K is a pressure intensifying ratio of the pressure intensifying cylinder, Pp is a rated pressure of a hydraulic pump and PLa is a pressure in the head-side cylinder chamber when a maximum load occurring after Pp is balanced with a load acting on a piston rod of the working cylinder in a piston-rod advancing step of the working cylinder is applied, and $\Delta V\geqq(PLa-Pp)\times Va\times\beta$ where $\Delta V$ is a maximum discharge volume of the pressure intensifying chamber of the pressure intensifying cylinder, Va is a volume of the head-side cylinder chamber when balance is held and $\beta$ is a compressibility of the hydraulic fluid, and the pressure intensification control means supplies the hydraulic fluid to the drive chamber of the pressure intensifying cylinder when $Sr>Ss\geqq Sp$ where Ss is a level of the detection signal from the pressure sensor, Sp is a level of an output signal corresponding to Pp and Sr is a level of an output signal corresponding to PLa, and discharges the hydraulic fluid from the drive chamber of the pressure intensifying cylinder when $Ss>Sr$.

According to this invention, the pressure of the head-side cylinder chamber is detected by the pressure sensor without using the check-valve equipped sequence valve unlike the first invention. When the detected pressure Ps is $PLa>Ps\geqq Pp$, the pressure intensifying cylinder pressurizes the head-side cylinder chamber of the working cylinder, and when it is $Ps>PLa$, the pressure intensifying cylinder depressurizes the head-side cylinder chamber.

Namely, when the pressure of the head-side cylinder chamber of the working cylinder is more than Pp, the pressure is automatically increased to keep PLa.

Since adaptive control is performed as measuring the pressure of the head-side cylinder chamber in actual, the condition of the pressure intensifying ratio of the pressure intensifying cylinder: K is the same as that of the first invention, but the maximum discharge volume of the pressure intensifying chamber: $\Delta V$ may be more than $[(PLa-Pp)\times Va\times\beta$ without having to be set fixedly.

Namely, in this invention, discharge and supply control for the working cylinder and pressure intensifying cylinder must be individually executed. However, in the case of $\Delta V>(PLa-Pp)\times Va\times\beta$, this invention has an advantage in which the pressure intensifying cylinder having a common specification can deal with the wide range of the specification of the working cylinder.

In the case of opposing to the maximum load occurring in the reversing step, the pressure intensifying chamber of the pressure intensifying cylinder is made to communicate with the rod-side cylinder chamber of the working cylinder, and the pressure of the rod-side cylinder chamber is measured by the pressure sensor and the pilot check valve may be provided in reverse at the head side and the rod side.

The third invention relates to a pressure intensifying apparatus for a hydraulic cylinder comprising: a working cylinder; a pressure intensifying cylinder for allowing a pressure intensifying chamber to communicate with a head-side cylinder chamber of the working cylinder; a switching valve for controlling supply and discharge of a hydraulic fluid with respect to a head-side port and a rod-side port of the working cylinder; a pilot check valve which is disposed in a head-side supply and discharge circuit for connecting the head-side port of the working cylinder to the switching valve and whose pilot pressure is a pressure of a rod-side supply and discharge circuit for connecting the rod-side port of the working cylinder to the switching valve; position detection means for detecting when a piston rod of the working cylinder reaches a known position of the piston rod where a rated pressure of a hydraulic pump is balanced with a load acting on the piston rod of the working cylinder in a piston-rod advancing step of the working cylinder; and pressure intensification control means for starting supplying the hydraulic fluid to a drive chamber of the pressure intensifying cylinder based on a detection signal from the position detection means in the piston-rod advancing step of the working cylinder, wherein $K>PLa/Pp$ is satisfied where K is a pressure intensifying ratio of the pressure intensifying cylinder, Pp is the rated pressure of the hydraulic pump and PLa is a pressure in the head-side cylinder chamber when a maximum load occurring after the position detection means makes that detection is applied, and $\Delta V=(PLa-Pp)\times Va\times\beta$ where $\Delta V$ is a maximum discharge volume of the pressure intensifying chamber of the pressure intensifying cylinder, Va is a volume of the head-side cylinder chamber when the position detection means makes the detection and $\beta$ is a compressibility of the hydraulic fluid.

The second invention uses the pressure sensor, whereas this invention uses position detection means for detecting the position of the piston rod of the working cylinder when reaching a predetermined position.

Generally, in the case where the pressure intensifying apparatus is adapted to the hydraulic cylinder, the position of the piston rod where the working cylinder needs pressure intensifying is experientially known in many cases. This makes it possible to perform the start of driving the pressure intensifying cylinder based on position detecting information.

Various kinds of prior art such as means using a limit switch, means using a magnetic sensor or an inductance sensor can be used as position detecting means.

It is noted that the conditions of the pressure intensifying cylinder are the same as those of the first invention since this case aims to detect only the timing at when the pressure intensifying cylinder is started to drive.

In the case of opposing to the maximum load occurring in the reversing step, the pressure intensifying chamber of the pressure intensifying cylinder is made to communicate with the rod-side cylinder chamber of the working cylinder, and the pilot check valve may be provided in reverse at the head side and the rod side.

BRIEF DESCRIPTION OF THE DRAWINGS

These objects and other objects and advantages of the present invention will become more apparent upon reading of the following detailed description and the accompanying drawings in which.

DETAILED DESCRIPTION OF THE PREFERRED EMBODIMENTS

Preferred embodiments of the present invention relating to "a pressure intensifying apparatus for a hydraulic cylinder" will be specifically explained with reference to FIGS. 1 to 9.

It is noted that the following embodiments explain a pressure intensifying apparatus as a target which is adapted to the working cylinder for use in a core driving cylinder in a die cast machine as illustrated in the prior art.

[First embodiment]

Figure 1:
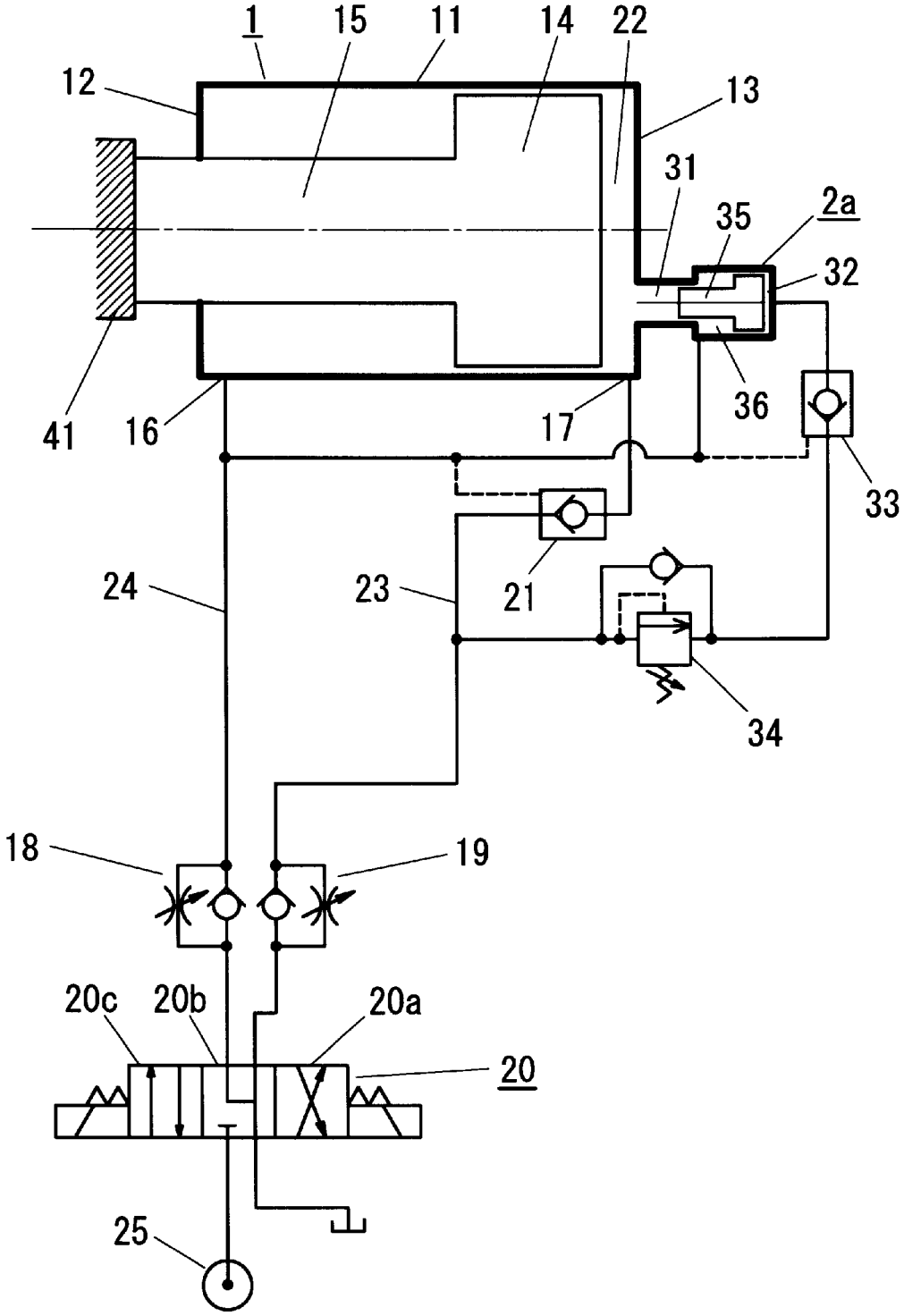
FIG. 1 is a schematic structural view of a cylinder illustrating the structure of a working cylinder and that of a pressure intensifying apparatus and its hydraulic circuit diagram according to a first embodiment.

The structure of a working cylinder and that of a pressure intensifying apparatus according to this embodiment are illustrated in FIG. 1.

In the figure, reference numeral 1 denotes a working cylinder and 2*a* denotes a pressure intensifying cylinder.

Figure 10:
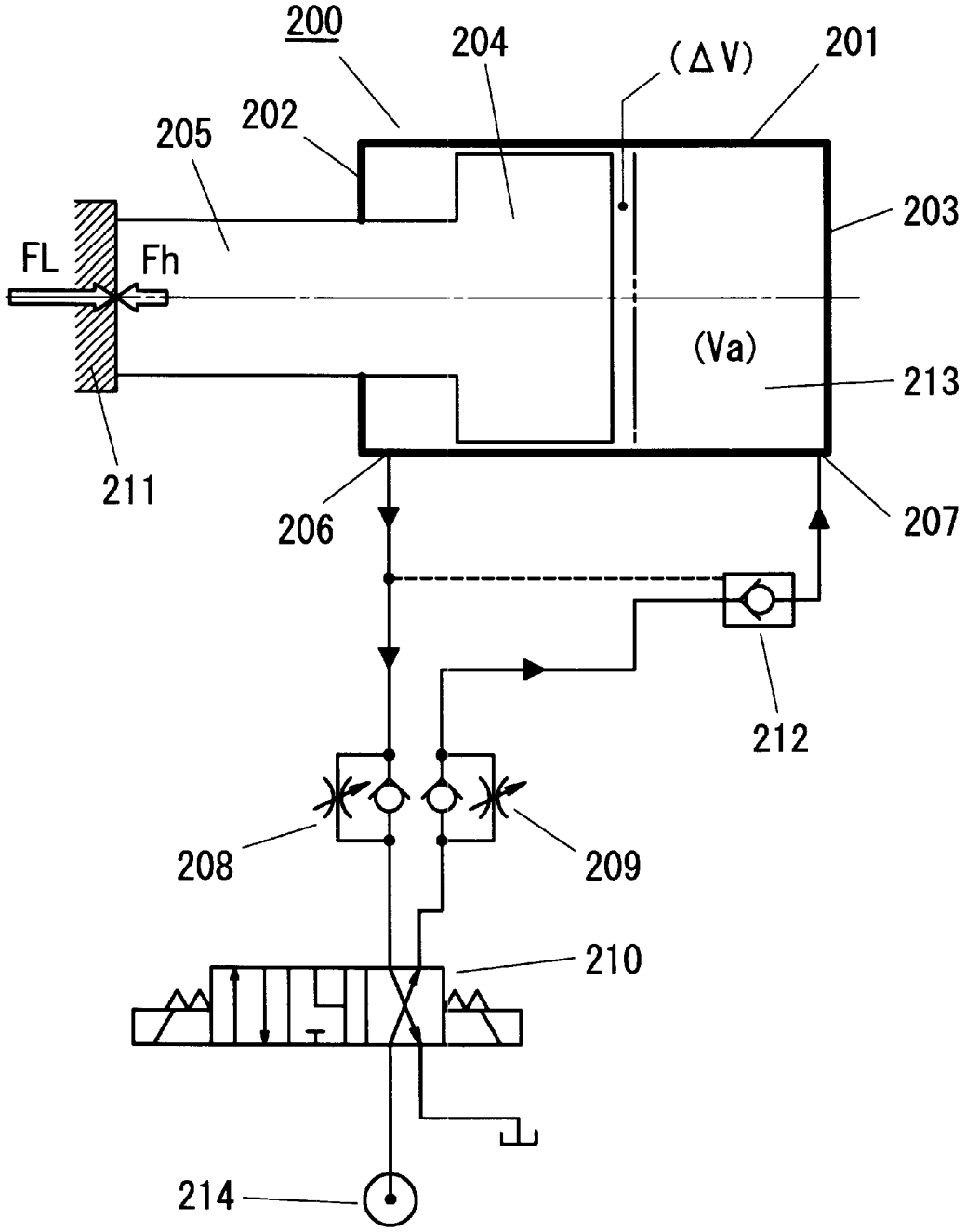
Fig. 10 (Conventional Art)
FIG. 10 is a schematic structure of a conventional core pressing hydraulic cylinder and its hydraulic circuit diagram.

In the working cylinder 1, 11 denotes a cylinder tube, 12: a rod cover, 13: a head cover, 14: a piston, and 15: a rod. The supply and discharge of a hydraulic fluid with respect to a head-side port 16 and a rod-side port 17 are performed by a 4-port, 3-position switching valve 20 via meter-in circuits 18 and 19. Also, a pilot check valve 21 is disposed between the head-side port 17 and the meter-in circuit 19, and the pilot pressure is inputted from the rod-side port 16. These points are the same as the structure of the hydraulic cylinder and that of the hydraulic circuit illustrated in the prior art (FIG. 10).

This embodiment has the feature in the following point.

More specifically, the pressure intensifying cylinder 2*a* allows a pressure intensifying chamber 31 to communicate with a head-side cylinder chamber 22 of the working cylinder 1. Then, a driving chamber 32 is connected between the pilot check value 21 in a head-side supply and discharge circuit 23 of the working cylinder 1 and the meter-in circuit 19 by a hydraulic circuit having a pilot check value 33 and a check-valve equipped valve 34 disposed therein.

Herein, a pilot pressure of the pilot check valve 33 is supplied from the a rod-side supply and discharge circuit 24 similar to the pilot check value 21, and a check-valve equipped sequence value 34 is designed to switch from a closed state to an open state with a rated pressure Pp of a hydraulic pump 25.

In the pressure intensifying cylinder 2*a* of this embodiment, the pressure intensifying chamber 31 is used as a communicating passage to the head-side cylinder chamber 22 of the working cylinder 1 and a plunger rod 35 is internally fitted and slid into the pressure intensifying chamber 31, and an intermediate chamber 26 is connected to the rod-side supply and discharge circuit 24.

Additionally, the structure of the pressure-identifying cylinder 2*a* is not limited to the above, and the structure such that the plunger rod 35, serving as a combination of a small-sized piston and a rod, is coupled to a large-sized piston side may be used, namely, any cylinder that exerts a pressure intensifying function may be used.

Figure 2:
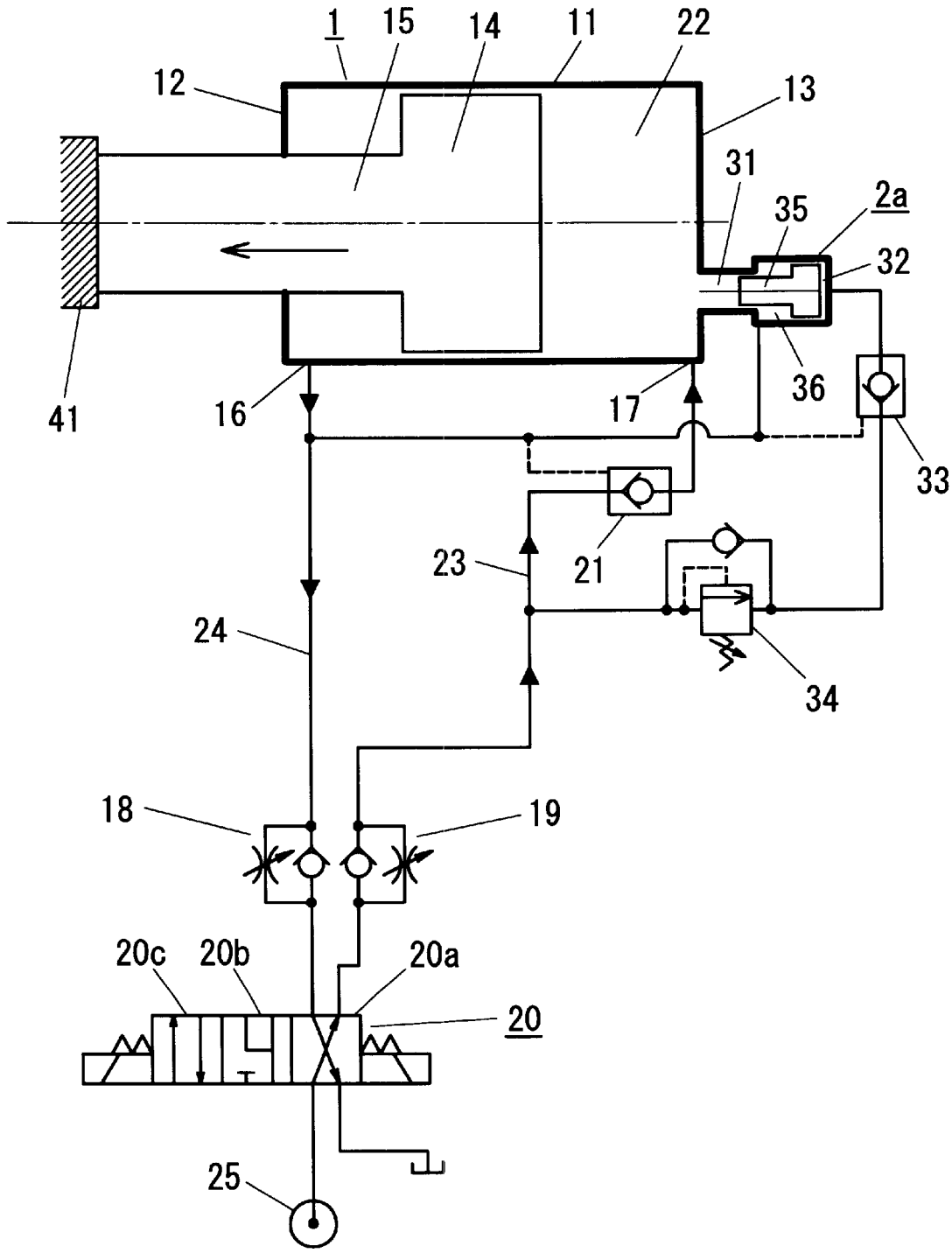
FIG. 2 is a schematic structural view of a cylinder and its hydraulic circuit diagram to explain the advancing state of a piston rod according to the first embodiment.

With the above-mentioned structure, in a state that the piston rod 14, 15 of the working cylinder 1 and the plunger rod 35 of the pressure intensifying cylinder 2*a* are in a backward limit as illustrated in FIG. 1, the switching valve 20 is switched to a switch position 20*a* to perform the supply and discharge of the hydraulic fluid. As a result, the pilot check valve 21 is closed and the piston rod 14, 15 advances with a core 41 as illustrated in FIG. 2.

Here, a load is little applied on the piston rod 14, 15 in the advancing step and the check-valve equipped sequence value 34 is held closed, and the driving chamber 32 of the pressure intensifying cylinder 2*a* is not pressurized.

After that, when the rod 15 further advances the core 41, the core 41 reaches a predetermined position provided at a mold (not shown) side and abuts against the surface of the mold side in its flange and the like and cannot move forward any more. As a result, the core 41 stops with the tip end thereof inserted into a cavity by a necessary amount.

Namely, in the case of the common die cast machine, the setting of core 41 is completed in the aforementioned state, and the injection of molten metal into the cavity is started.

Figure 3:
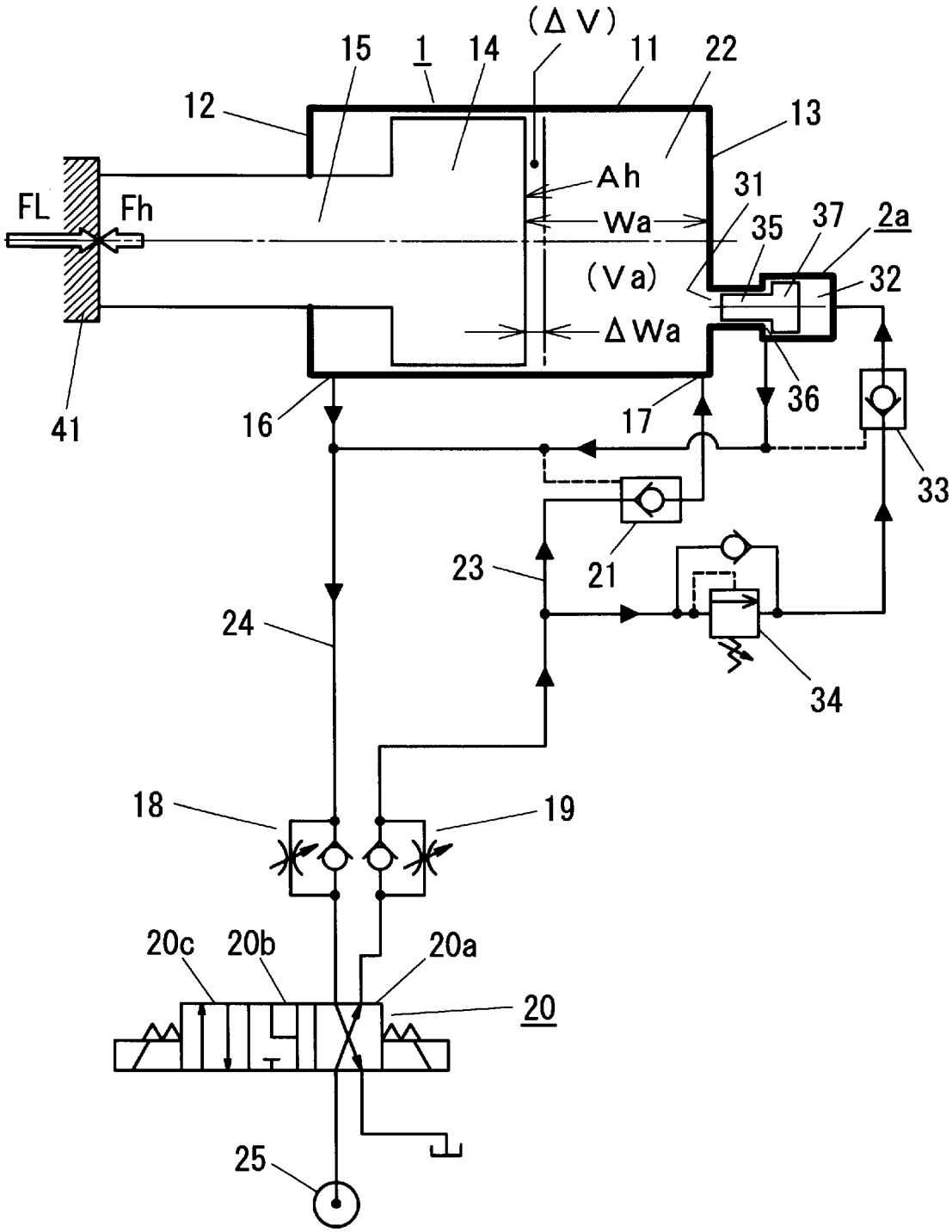
FIG. 3 is a schematic structural view of a cylinder and its hydraulic circuit diagram to explain the starting/driving state of a pressure intensifying cylinder according to the first embodiment.

However, according to this embodiment, an advancing force Fh caused with a rated pressure Pp of the hydraulic pump 25 is balanced with a load on the piston rod 14, 15 applied from the core 41 at the stage where the core 41 is set as mentioned above. As a result, the pressure of the head-side cylinder chamber 22 and that of the head-side supply and discharge circuit 23 become the rated pressure Pp of the hydraulic pump 25 and the opened pilot check value 21 is closed as illustrated in FIG. 3.

At the stage where balanced is held as mentioned above, the pressure of the primary side of the check-valve equipped sequence valve 34 rises up to the rated pressure Pp of the hydraulic pump 25. The sequence valve 34 is switched from the close state to the open state and the pilot check valve 33 is also opened, with the result that the driving chamber 32 of the pressure intensifying cylinder 2*a* becomes the rated pressure Pp.

Accordingly, the pressure intensifying cylinder 2*a* started to move at the stage. The pressure intensifying cylinder 2*a* is designed in such a way that its pressure intensifying ratio is set to K and its maximum discharge volume is set to $\Delta V$ when the plunger rod 35 of the pressure intensifying chamber 31 moves from the backward limit to the forward limit. The advancement of the pressure intensifying cylinder 2*a* supplies the hydraulic liquid from the pressure intensifying chamber 31 to the head-side cylinder chamber 22 of the working cylinder 1 by the volume $\Delta V$ and rises the pressure of the cylinder chamber 22 to K·Pp from Pp.

It is noted that the hydraulic fluid in the intermediate chamber 36 is discharged to the rod-side supply and discharge circuit 24, which is connected to a drain side, when the pressure intensifying cylinder 2*a* drives forward.

Then, in the die cast machine to which the pressure intensifying apparatus of this embodiment is adapted, the injection of molten metal is started after the starting operation of the pressure intensifying cylinder 2*a* is completed, and the molten metal is charged into the cavity.

The core 41 is put in the high-heated and semimolten molten metal in the cavity, but the molten metal is injected and charged into the cavity under high pressure corresponding to the molding pressure. For this reason, the push-back force FL equivalent to (the molding pressure×the pressure receiving area) acts on the core 41.

Generally, the push-back force FL is equivalent to several times as large as the driving force of the piston 14 caused with the rated pressure Pp of the hydraulic pump 25.

Herein, it is assumed that the pressure intensifying cylinder 2*a* is not additionally provided to the working cylinder 1 (namely, the structure of FIG. 10) and that the head-side cylinder chamber 22 of the working cylinder 1 remains the rated pressure Pp of the hydraulic pump 25.

In this case, since the pilot check valve 21 is closed, the head-side cylinder chamber 22 of the working cylinder 1 is sealed tightly against the push-back force FL. The pressure of the hydraulic fluid rises from Pp and keeps its balance, but the hydraulic fluid has a compressibility, very small through it is.

The compressibility of the hydraulic fluid is about 3 to $9\times10^{-5}$ ($cm^2$/kgf) at 20 to 80° C. though it slightly differs depending on the kinds of fluids. In the general hydraulic cylinder, the hydraulic fluid may be treated as an incompressive fluid. However, when the push-back force FL is strong and the pressure volume of the core 41 ensures the high dimensional accuracy of products directly, the compressibility of the hydraulic fluid cannot be ignored in some cases.

More specifically, an increase in the pressure of the hydraulic fluid $\Delta Pa$ of the head-side cylinder chamber 22 after the balance is held becomes (PLa−Pp) where PLa is a pressure equivalent of push-back force FL. A compression quantity ΔV of the hydraulic fluid due to the increase in the pressure is given by $\Delta V=\Delta Pa\times Va\times\beta$ where Va is a volume of the head-side cylinder chamber 22 when balance is held and β is a compressibility of the hydraulic fluid. For example, $\Delta V=\{(FL/Ah)-Pp\}\times(Ah\times Wa)\times\beta=3.5$ ($cm^3$) is satisfied where a pressure receiving area Ah of the piston 14 is 78.5 ($cm^2$) (equivalent of 10 cm of diameter), a process length Wa from the backward limit when balance is held is 6.4 (cm), a rated pressure Pp of the hydraulic pump 25 is 70 ($kg/cm^2$), the push-back force FL is $2.2\times10^4$ (kg)=[Pp×4×Ah] and a compressibility β of the hydraulic fluid is $3.33\times10^{-5}$ ($cm^2$/kgf). The piston rod 14, 15 are returned by $\Delta Wa=\Delta V/Ah=0.045$ (cm).

This value is extremely small in view of the process length of the hydraulic cylinder 1. In some cases, such a value cannot be ignored when the high dimensional accuracy is required in the case that no secondary operation is needed in the casting products.

Here, returning to the explanation of the pressure intensifying apparatus of this embodiment, the pressure intensifying cylinder 2*a* is designed in such a way as to satisfy the conditions ①: K>PLa/Pp and ②: $\Delta V=\Delta Pa\times Va\times\beta$ where K is a pressure intensifying ratio and ΔV is a maximum discharge volume of the pressure intensifying chamber 31 as mentioned above.

Namely, the pressure intensifying ratio K of the pressure intensifying cylinder 2*a* is equivalent to K=(pressure receiving area of piston 37)/(pressure receiving area of plunger rod 35). However, the pressure intensifying cylinder 2*a* is designed in such a way that K is larger than (PLa/Pp) and that [(pressure receiving area of plunger rod 35)×maximum process length] is equal to (ΔPa×Va×Δ).

Accordingly, even if the load from the core 41 is increased by the molding pressure applied to the molten fluid in the cavity to generate the push-back force FL, the pressure of the head-side cylinder chamber 22 of the working cylinder 1 becomes higher than PLa based on the above condition ① given to the pressure intensifying cylinder 2*a* at this stage. Also, compensation for the compression quantity of the hydraulic fluid, which corresponds to the increase in the pressure of the hydraulic fluid of the head-side cylinder chamber 22 generated by the action of push-back force FL, is made by the above condition ②. This makes it possible to prevent the reverse of the spin rod 14, 15.

As a result, an error, which is caused by the compression of the hydraulic fluid, is not generated in the casting product obtained by solidifying the molten metal in the cavity, so that the product with high dimensional accuracy can be obtained.

Moreover, regarding the maximum discharge volume ΔV of the pressure intensifying cylinder 2*a,* extremely small volume of 3.5 ($cm^3$) may be used even in the aforementioned case. The pressure intensifying cylinder may be additionally provided to the head cover 13 of the working cylinder 1 as a microminiature cylinder. Furthermore, the pressure intensifying cylinder may be buried in the thickness of the head cover 13 or cylinder tube 11.

Figure 4:
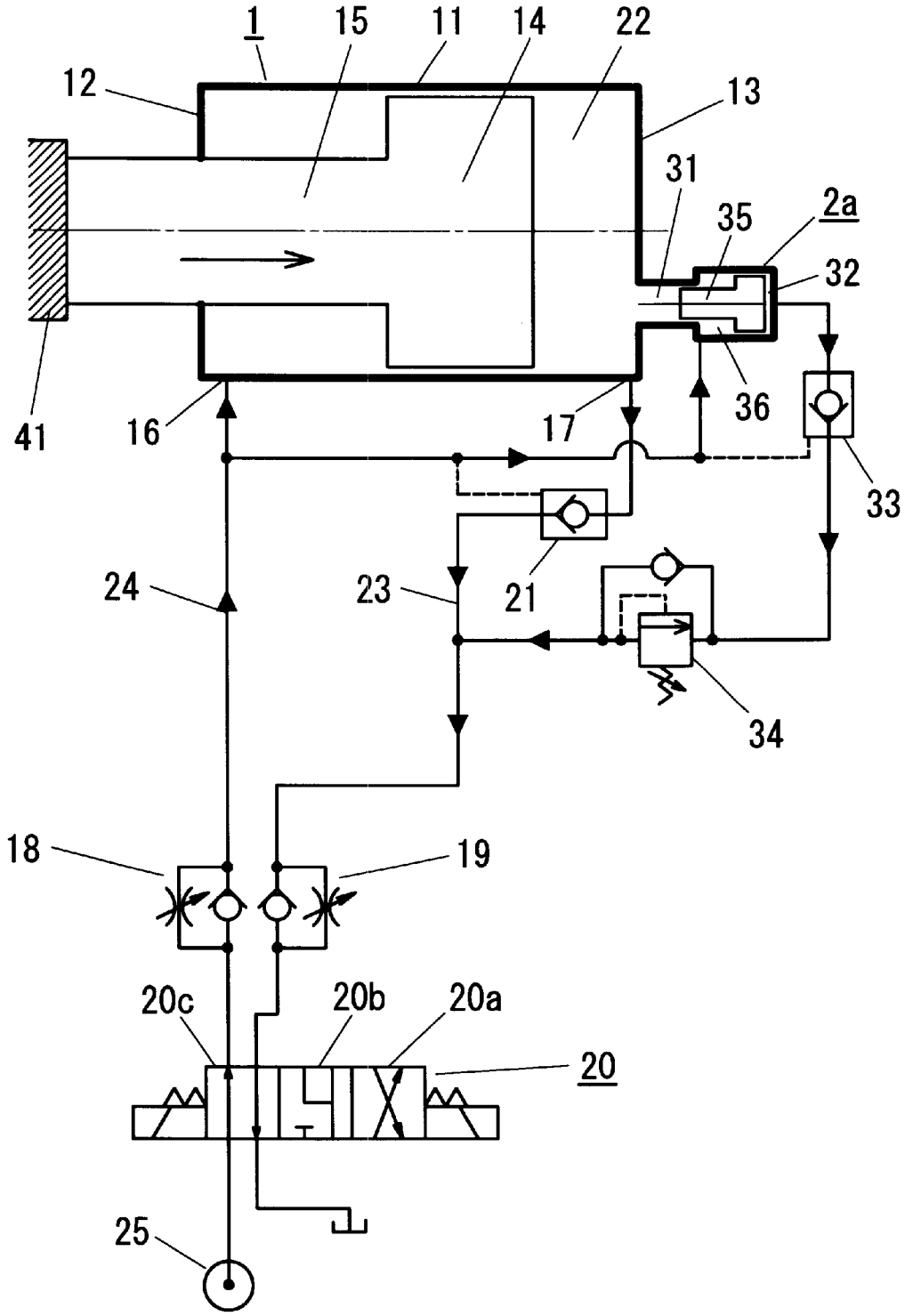
FIG. 4 is a schematic structural view of a cylinder and its hydraulic circuit diagram to explain the reversing state of the piston rod according to the first embodiment.

After the above casting process is completed, the cavity is opened to move the piston rod 14, 15 backward, and this state is illustrated in FIG. 4.

In this state, the switching valve 20 is switched to the switching position 20*c,* which is opposite to the above, to move the piston rod 14, 15 backward. In this case, the closed pilot check valves 21 and 23 are opened by the above switching since the pressure of the rod-side supply and discharge circuit 24 is used as the pilot pressure. The hydraulic fluid in the head-side cylinder chamber 22 of the working cylinder 1 and that of the driving chamber 32 of the pressure intensifying cylinder 2*a* are discharged to the drain side, respectively. The hydraulic fluid is supplied to the intermediate chamber 36 of the pressure intensifying cylinder 2*a* from the rod-side supply and discharge circuit 24, with the result that the piston 37 and the plunger rod 35 are retuned to the backward limit.

Accordingly, the working cylinder 1 and the pressure intensifying cylinder 2*a* return to the initial state (state of FIG. 1), and wait for execution of the next casting process.

[Second embodiment]

Figure 5:
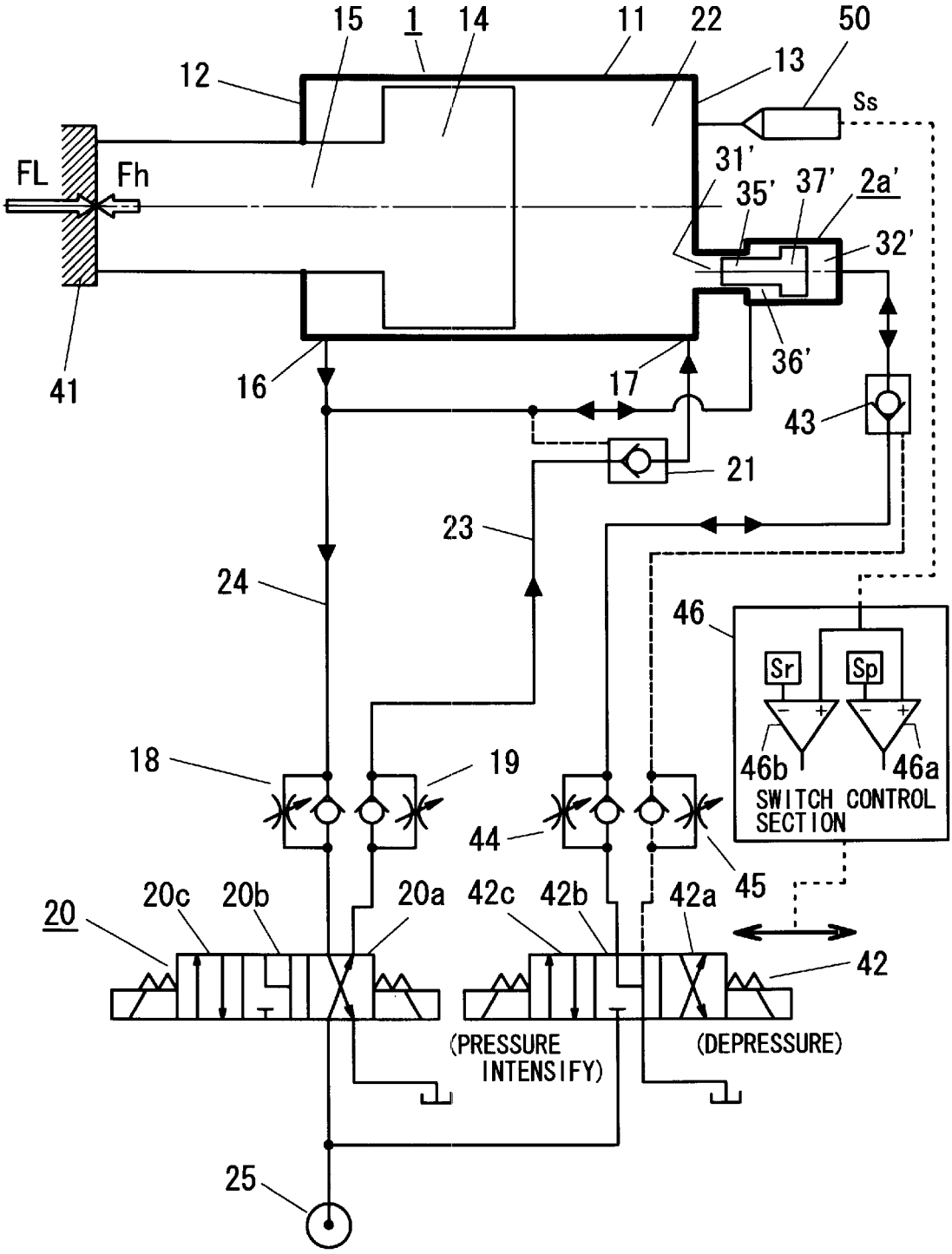
FIG. 5 is a schematic structural view of a cylinder illustrating the structure of a working cylinder and that of a pressure intensifying apparatus and its hydraulic circuit diagram according to a second embodiment.

The structure of the working cylinder and that of the pressure intensifying apparatus according to this embodiment are illustrated in FIG. 5, and this figure shows the state corresponding to FIG. 3 of the first embodiment.

As is obvious from the comparison between FIG. 3 and FIG. 5, this embodiment is the same as the first embodiment in the structure of the working cylinder 1, that of the hydraulic circuit for driving, and the point that a pressure intensifying cylinder 2*a*' is added such that its pressure intensifying chamber 31' is made to communicate with the head-side cylinder chamber 22 of the working cylinder 1.

Accordingly, in FIG. 5, the components indicated by the reference numerals common to FIG. 3 are the same as those of FIG. 3. Mark "'" is added to the pressure intensifying cylinder 2*a*' and the structural components and this means that they are the same as those of the first embodiment in terms of the functions but different values are obtainable in terms of the size and the volume.

In this embodiment, unlike the first embodiment, the pressure intensifying cylinder 2' is not controlled by the same hydraulic circuit as used in the working cylinder 1. Namely, the pressure intensifying cylinder 2' is designed to be controlled by a different hydraulic circuit independently.

For this reason, the pilot check valve 33 and the check-valve equipped sequence valve 34, serving as hydraulic circuit components in the first embodiment, are not provided in this embodiment. Instead, there are provided a pressure sensor 50 for detecting the pressure of the head-side cylinder 22, a 4-port, 3-position switching valve 42 for executing the selection of the supply and discharge of the hydraulic fluid to/from a driving chamber 32' of the pressure intensifying cylinder 2*a*', a pilot check value 43 and meter-in circuits 44, 45, which are disposed between the driving chamber 32' and the switching valve 42, and a switch control section 46 for automatically controlling switch positions 42*a* to 42*c* of the switch valve 42 based on detection signals (Ss) that are outputted from the pressure sensor 50.

The main circuit of the pilot check valve 43 is connected to the driving chamber 32' of the pressure intensifying cylinder 2*a*' and one meter-in circuit 44, and the pilot input is connected to the other meter-in circuit 45, and the supply and discharge control is executed via the pilot check 43 by the switch valve 42.

The switch control section 46 prestores Sp and Sr, which are equivalent to signal level values corresponding to the rated pressure Pp of the hydraulic pump and the maximum load FL that is applied to the core 41. Comparison between the levels of detection signals (Ss) from the pressure sensor 50 and the respective level values Sp and Sr are performed by comparators 46*a* and 46*b* built in the switch control section 46, and the control of switch valve 42 is executed based on the comparison result.

With the above structure, in the advancing step of the working cylinder 1, the switch valve 20 is changed to the switch position 20*a* as the switch valve 42 stays at a neutral position in the state that a piston 37' of the pressure intensifying cylinder 2*a*' and the plunger rod 35' are positioned at the backward limit.

By the continuation of the advancing step of the working cylinder 1, the advancing force Fh of the piston rod 14, 15 caused with the rated pressure Pp of the hydraulic pump 25 is balanced with the load received from the core 41 (state where balance is held at the stage in which the core 41 is fitted into the predetermined position of the mold). As a result, the opened pilot check valve 21 is closed and the advancement of the piston rod 14, 15 stops temporarily.

Then, the pressure of the head-side cylinder chamber 22 becomes Pp in this state. For this reason, the signals Ss of the pressure become the level value Sp, the comparator 46*a* of the switch control section 46 outputs the detection signals, and the switch control section 46 switches the switch valve 42 from the neutral position 42*b* to the pressure intensifying position 42*c*.

Whereby, the closed pilot check valve 43 is opened to supply the hydraulic fluid to the driving chamber 32' of the pressure intensifying chamber 2*a*', so that the piston rod 35', 37' are moved forward. The pressure intensifying chamber 2*a*' of this embodiment is, however, designed in such a way as to satisfy the condition of a pressure intensifying ratio K: K>PLa/Pp similar to the first embodiment and the condition of a maximum discharge volume ΔV: ΔV>(PLa−Pp) ×Va×β. In this case, the definitions of PLa, Va, and β are the same as those of the first embodiment.

Accordingly, as mentioned above, the core 41 is fitted into the predetermined position of the mold to stop the piston rod 14, 15 of the working cylinder 1. In this state, the hydraulic fluid is supplied to the head-side cylinder chamber 22 from the pressure intensifying chamber 31' of the pressure intensifying cylinder 2*a*', with the result that the pressure of the cylinder chamber 22 is increased.

By the way, in the pressure intensifying cylinder 2*a*', the pressure intensifying ratio K is K>PLa/Pp similar to the first embodiment. However, regarding the maximum discharge volume ΔV, this embodiment shows ΔV>(PLa−Pp)×Va×β as against ΔV=(PLa−Pp)×Va×β in the first embodiment.

According to these conditions, it is preferable that the head-side cylinder chamber 22 of the working cylinder 1 can be increased to the pressure larger than PLa by the advancement of the pressure intensifying cylinder 2*a*'. However, because of ΔV>(PLa−Pp)×Va×β, the hydraulic fluid is supplied to the head-side cylinder chamber 22 from the pressure intensifying cylinder 2*a*' beyond the compression quantity of the hydraulic fluid due to the maximum load FL that is applied to the core 41 is applied based on molding pressure described later.

Namely, compensation for the volume of [(PLa−Pp)×Va×β] is good enough to make the pressure of the head-side cylinder chamber 22 larger than PLa. Nevertheless, extra hydraulic fluid, which is equivalent to {ΔV−[(PLa−Pp)×Va×β]}, is sent to the head-side cylinder chamber 22, thereby forming an excessively high-pressure in the cylinder chamber 22.

In this case, there is a possibility of breakage in a seal member and the like, and this could cause a problem such as trouble of frequent occurrence of fluid leakage.

According to this embodiment, the switch control section 46 executes a control sequence as checking the comparison result of comparators 46*a* and 46*b*, whereby maintaining the pressure of the head-side cylinder chamber 22 of the working cylinder 1 with PLa. Regarding the control sequence mentioned above, the switch control section 46 switches the switch valve 42 to the pressure intensifying position 42*c* when the level of the detection signal Ss of the pressure sensor 50 is the range of Sr>Ss≧Sp, to the neutral position 42*b* in the range of Sr=Ss, and to the depressure 42*a* in the range of Ss>Sr.

At the control stage, the point that the intermediate chamber 36' of the pressure intensifying cylinder 2*a*' is connected to the rod-side supply and discharge circuit 24 of the working cylinder 1, which is connected to the drain side, is the same as the first embodiment.

As a result, the molten metal is injected into the cavity with the core 41 set to the cavity. Even if the load from the core 41 is increased by the molding pressure to generate the push-back force FL, the reverse of the spin rod 14, 15 can be prevented for the following reasons.

More specifically, the pressure of the head-side cylinder chamber 22 of the working cylinder 1 becomes higher than PLa beforehand similar to the first embodiment. Also, compensation for the compression quantity of the hydraulic fluid, which corresponds to the increase in the pressure of the hydraulic fluid of the head-side cylinder chamber 22 generated by the action of push-back force FL, is made, so that After the casting process is completed, the cavity is opened to move the piston rod 14, 15 of the working cylinder 1 backward. In this case, the switch valve 20 of the working cylinder 1 is switched to the switch position 20*c*, the switch valve 42 of the pressure intensifying cylinder 2*a*' is switched to the depressure position 42*a*, respectively. Then, the closed pilot check valves 21 and 43 are opened and the piston rod 14, 15 of the working cylinder 1 are returned to the backward limit. Also, the piston 37' and the plunger rod 35' of the pressure intensifying cylinder 2*a*' are back the backward limit, returning to the initial state.

By the way, according to this embodiment, in designing the pressure intensifying cylinder 2*a*', the pressure intensifying ratio K is the same as the first embodiment, and the maximum discharge volume ΔV may be ΔV>(PLa−Pp)×Va×β.

This means that degree of freedom is provided to the specification of the pressure intensifying cylinder 2*a*'.

Namely, in the first embodiment, the condition of ΔV=(PLa−Pp)×Va×β must be satisfied, and the pressure intensifying cylinder can be adapted to only the working cylinder with the same value of [(PLa−Pp)×Va] in the case of using the hydraulic fluid with the same compressibility β. However, in the second embodiment, if the maximum discharge volume ΔV is designed as ΔV>(PLa−Pp)×Va×β, the pressure intensifying cylinder can be adapted to the working cylinder with a value larger than [(PLa−Pp)×Va].

In other words, the adaptive control using the pressure sensor 50 makes it possible to adapt the pressure intensifying cylinder 2*a*' designed with one specification to the working cylinder with a wide range of design specification, and to improve standardization of the pressure intensifying cylinder 2*a*'.

[Third embodiment]

Figure 6:
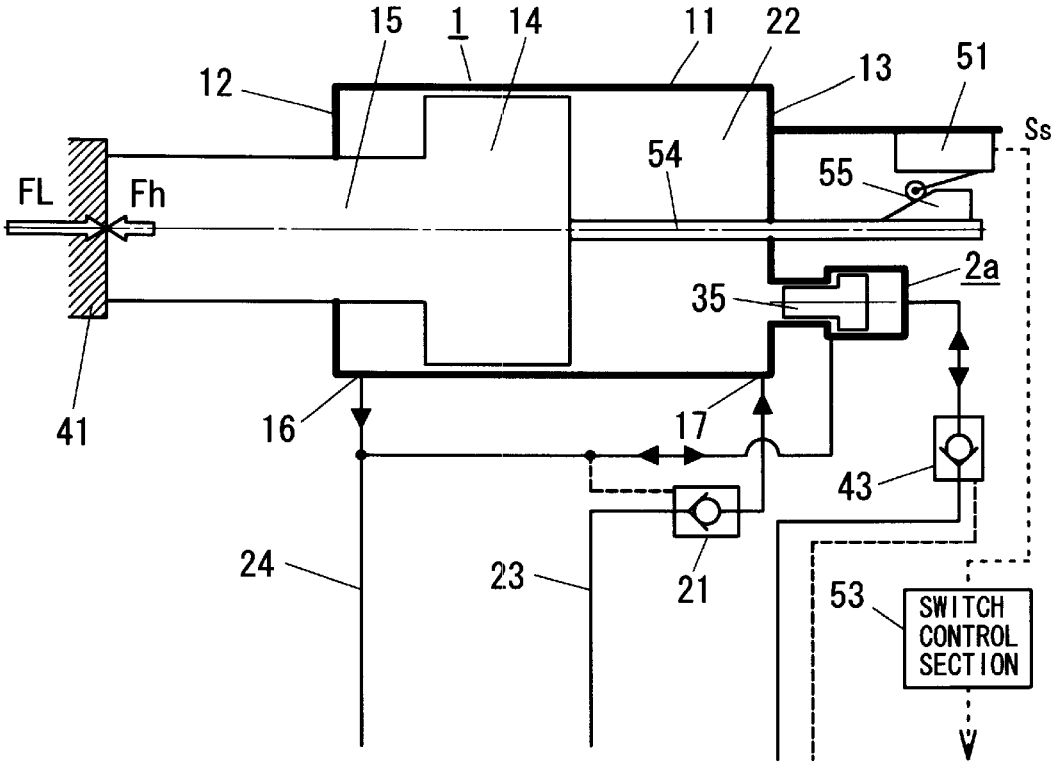
FIG. 6 is a view of illustrating the structure of a working cylinder and that of a pressure intensifying apparatus (where limit switching system is adapted as position detecting means for piston rod) according to a third embodiment (where a part of a hydraulic circuit on a hydraulic fluid supply side is omitted)
Figure 7:
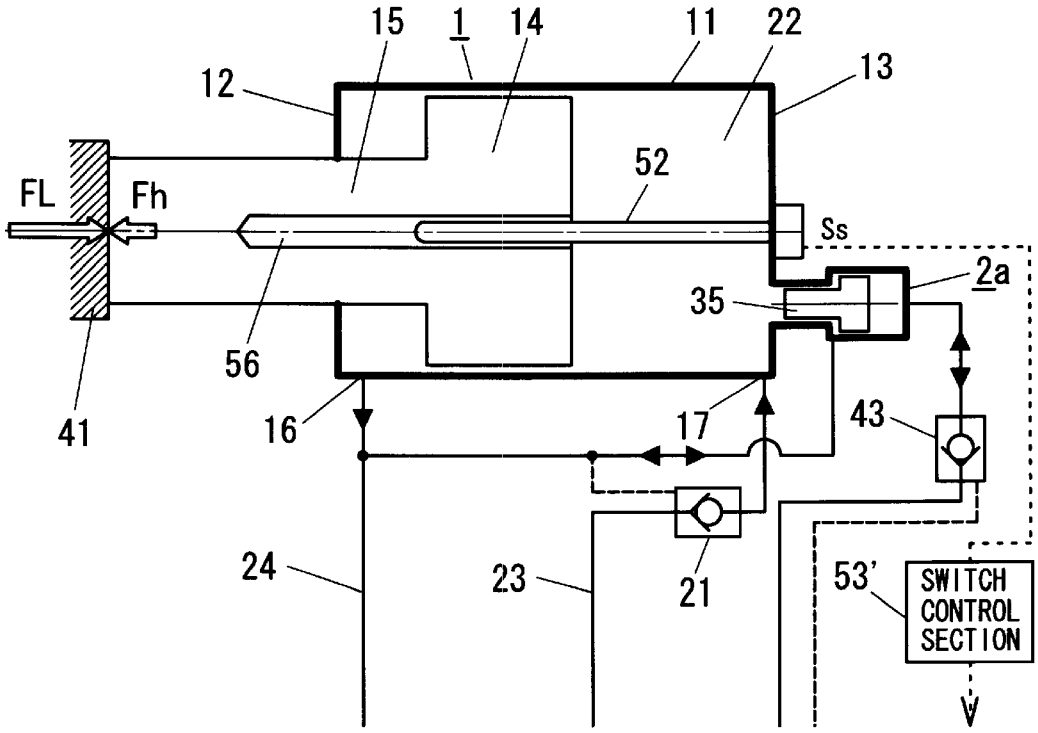
FIG. 7 is a view of illustrating the structure of a working cylinder and that of a pressure intensifying apparatus (where inductance sensor system is adapted as position detecting means for piston rod) according to the third embodiment (where a part of a hydraulic circuit on a hydraulic fluid supply side is omitted)

The structure relating to the general part of this embodiment is illustrated in FIGS. 6 and 7.

In each figure, the structure of the working cylinder 1 and that of the pressure intensifying cylinder 2*a* are the same as those of the first embodiment. The basic structure of the control hydraulic circuit is the same as that of the second embodiment though the allover structure is not illustrated.

Accordingly, the pressure intensifying cylinder 2*a* is designed in such a way that the pressure intensifying ratio K satisfies the condition of K>PLa/Pp and that the maximum discharge volume is $\Delta V=(PLa-Pp)\times Va\times\beta$ when the plunger rod 35 moves from the backward limit to the forward limit.

In the die cast machine, the set position of the core 41 in the insertion process (the position of piston rod 14, 15 when the advancing force caused with the rated pressure Pp of the hydraulic pump 25 is balanced with the load on the piston rod 14, 15 applied from the core 41) is known beforehand. For this reason, the feature of this embodiment lies in the provision of position detecting means 51 and 52 for detecting the known position and switch control sections 53 and 53' for moving the pressure intensifying cylinder 2*a* forward based on the detection signals of the position detecting means 51 and 52.

In, the structure of the apparatus illustrated in FIG. 6, a rod 54, which extends backward through the head cover 13, is consecutively installed on the back surface side of the piston 14 of the working cylinder 1, and a piece 55 is fixed at the back end portion of the rod 54. While, a limit switch 51 is installed fixedly in the rearward position of the head cover 13 (in the figure, it is fixed to a bracket attached to the back face of the head cover 13). Then, the piston rod 14, 15 of the working cylinder 1 is moved in such a way that the piece 55 turns ON/OFF the limit switch 51.

Then, the relative positional relationship between the limit switch 51 and the piece 55 is adjusted in such a way that the position of the piston rod 14, 15 corresponds to the set position of the core 41 when the limit switch 51 is changed by the piece 55.

Accordingly, the switch control section 53 switches the switch valve 42 (not shown) to the pressure intensifying position 42*c* based on the switch signals Ss of the limit switch 51 to advance the piston rod of the pressure intensifying cylinder 2*a* placed at the backward limit. This obtains the same effect as the case of the first embodiment.

In the structure of the apparatus illustrated in FIG. 7, the inductance sensor 52 for detecting a change as an output in a coefficient of electrostatic induction regarding a built-in excitation coil and a detection coil is internally inserted into a hole 56 formed in the piston rod 14, 15 through the head cover 13 of the working cylinder 1. The inductance sensor 52 is designed in such a way to detect the position of the piston rod 14, 15 based on the output signals Ss, which are sent from the inductance sensor 52 and which are changed by movement of the piston rod 14, 15.

It is noted that technique as disclosed in, for example, Japanese Patent Application HEI 11-138128 can be used as such inductance sensor 52.

Accordingly, regarding the position of the piston rod 14, 15 corresponding to the set position of the core 41, the output level of the inductance sensor 52 is prestored in the switch control section 53'. When the output signals Ss of the inductance sensor 52 reach the aforementioned level, the switch control section 53' switches the switch valve 42 (not shown) to the pressure intensifying position 42*c* to advance the piston and the plunger rod 35 of the pressure intensifying cylinder 2*a* placed at the backward limit. This obtains the same effect as the case of the first embodiment.

In the control system using position-detecting means 51 and 52, the pressure intensifying cylinder designed with one specification cannot be adapted to the working cylinder with a wide range of specification unlike the second embodiment. This control system, however, has an advantage in which the apparatus can be simply structured using the existing sensors for general purpose use.

As position detecting means other than the aforementioned two kinds, the following system can be used.

More specifically, if the actuating velocity of the piston rod 14, 15 of the working cylinder 1 is constant, the time elapsed between the backward limit and the state where balance is held is measured using a timer and the pressure intensifying cylinder 2*a* is moved forward after passing the measured time.

[Forth embodiment]

The first to third embodiments aim at the point in which the pressure intensifying cylinders 2*a* and 2*a*' are moved forward to compensate for the reverse of the spin rod 14, 15 caused by the compression of the hydraulic fluid in the advancing step of the piston rod 14, 15 of the working cylinder 1. While, the fourth embodiment aims to exert the same functions as mentioned above when an intense push-back force occurs in the reversing step.

For example, there is a case in which the die cast machine is subject to constraints in the arrangement of working cylinder 1, so that the insertion and setting of the core to the mold must be executed in the reversing step. This embodiment provides the pressure intensifying apparatus that deals with such a case.

Figure 8:
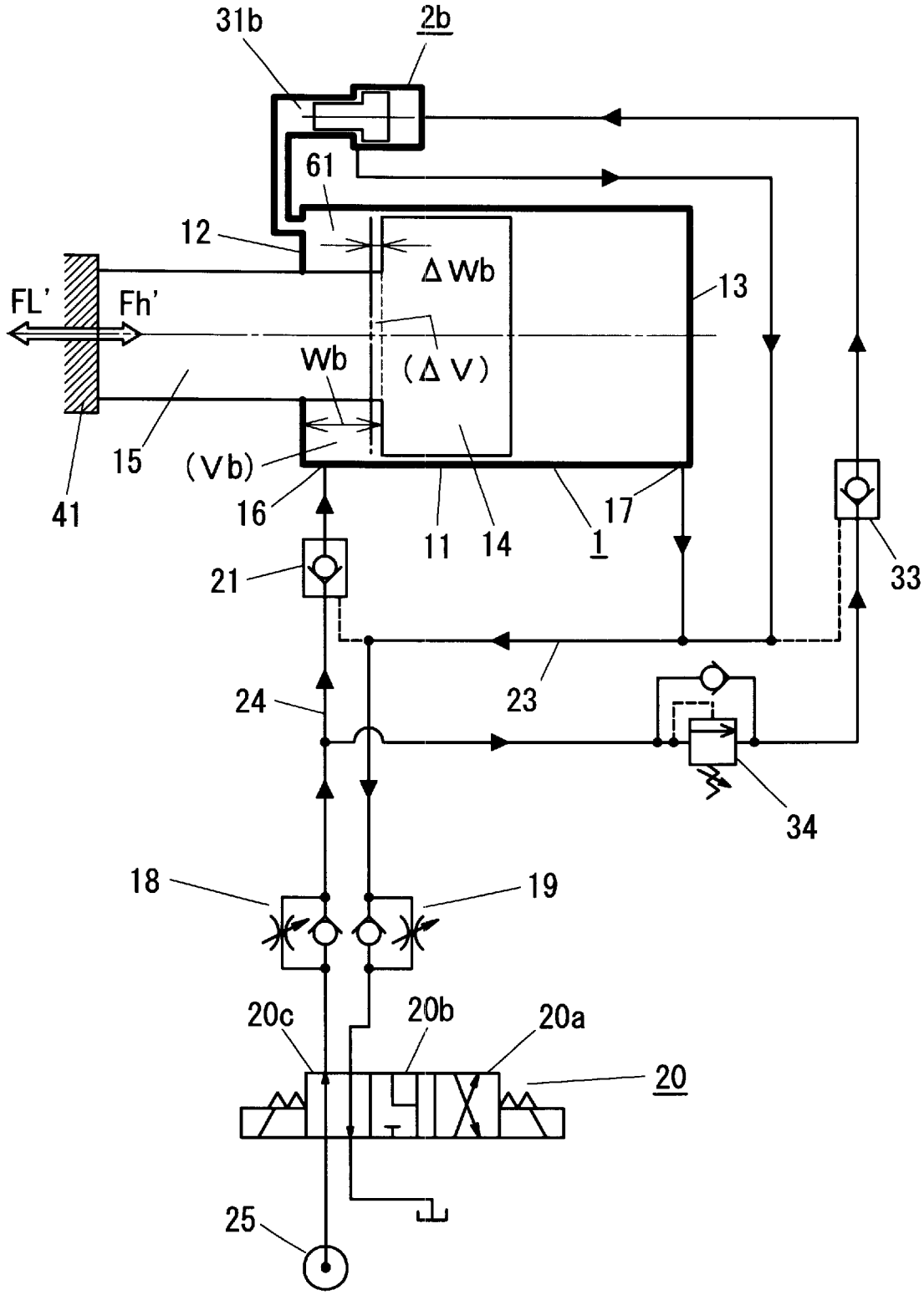
FIG. 8 is a schematic structural view of a cylinder illustrating the structure of a working cylinder and that of a pressure intensifying apparatus and its hydraulic circuit diagram (structure that implements the same functions as those of the first embodiment in the piston rod reversing step) according to a fourth embodiment.
Figure 9:
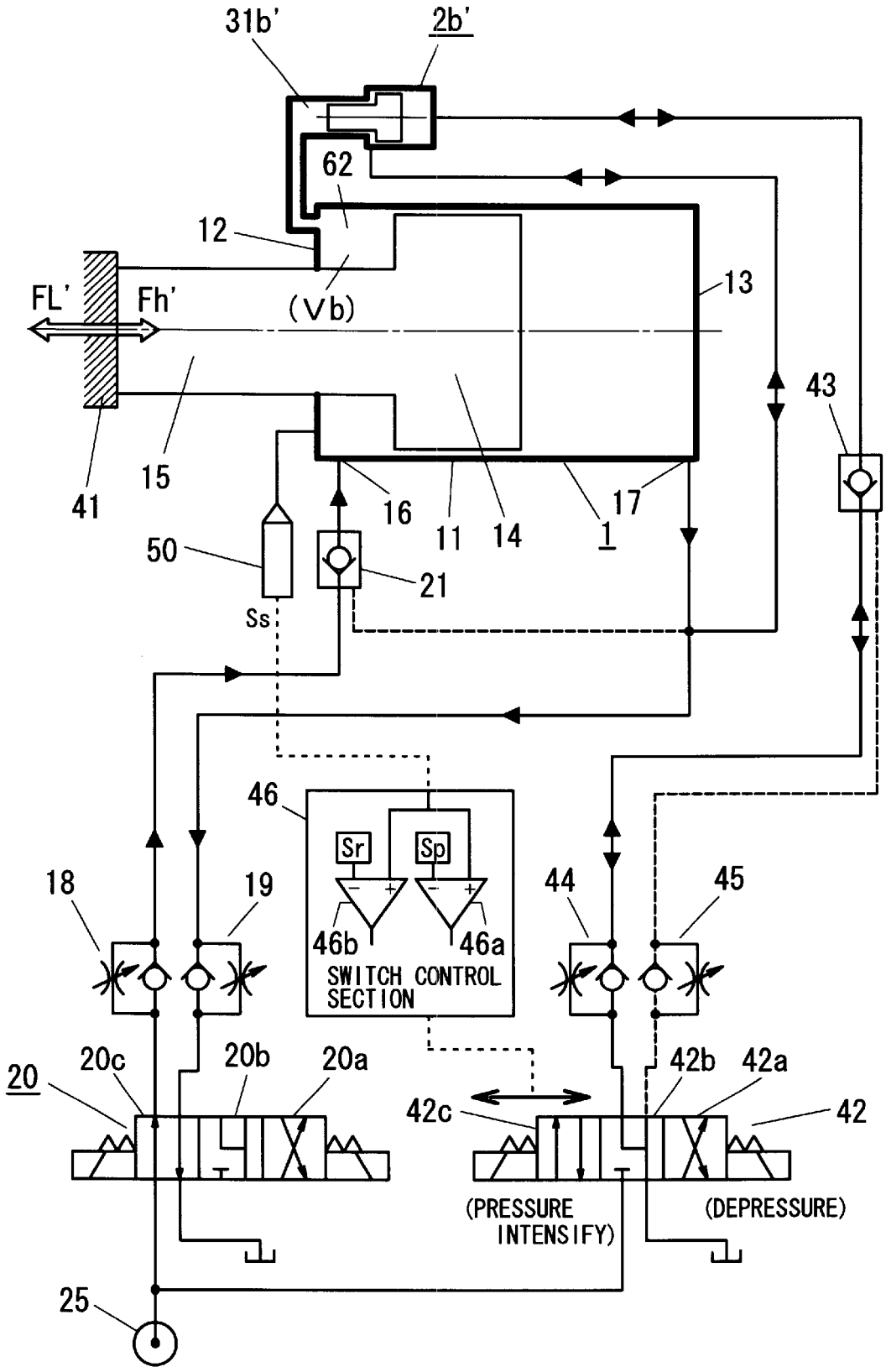
FIG. 9 is a schematic structural view of a cylinder illustrating the structure of a working cylinder and that of a pressure intensifying apparatus and its hydraulic circuit diagram (structure that implements the same functions as those of the second embodiment in the piston rod reversing step) according to a fourth embodiment.

The structure of the working cylinder and that of the pressure intensifying apparatus according to this embodiment are illustrated in FIGS. 8 and 9.

First, on the same principle as that of the first embodiment, the apparatus of FIG. 8 is intended to compensate for the return of the piston rod 14, 15 caused based on the compression of the hydraulic fluid generated by an intense push-back force FL' of the piston rod 14, 15 in the reversing step of the piston rod 14, 15.

As is obvious from the comparison between the structure of FIG. 8 and that of FIG. 1, in this embodiment, a pressure intensifying cylinder 2*b* allows its pressure intensifying chamber 31*b* to communicate with a rod-side cylinder chamber 61 of the working cylinder 1. Correspondingly, the pilot check valves 21 and 33 and the check-valve equipped sequence vale 34, which are hydraulic circuit components, are provided to establish the reverse relationship with respective to the case of the first embodiment at the head side and the rod side.

In this embodiment, the same state as that of the first embodiment occurs at the rod-side cylinder chamber 51 in the reversing step of the piston rod 14, 15. Then, a reversing force Fh' caused with a rated pressure Pp of the hydraulic pump 25 is balanced with the load (push-back direction) on the piston rod 14, 15 applied from the core 41, so that the pilot check valve 21 is closed. Thereafter, the closed check-valve equipped sequence vale 34 is opened to move the pressure intensifying cylinder 2*b* forward, with the result that the insertion and setting of the core 41 are completed.

After that, an intense load FL' (push-back direction), which is based on the molding pressure, acts on the piston rod 14, 15 by the injection of molten metal to the cavity. However, given that the pressure intensifying ratio K of the pressure intensifying cylinder 2*b* is K>PLb/Pp (where PLb is a pressure in the rod-side cylinder chamber 61 when a load FL' occurs), and a maximum discharge volume $\Delta V$ of the pressure intensifying chamber of the pressure intensifying cylinder 2 is $\Delta V=(PLb-Pp)\times Vb\times\beta$ (Vb is a volume of the rod-side cylinder chamber 61 when balance is held). This makes it possible to compensate for the compression quantity of the hydraulic fluid and to prevent the piston rod 14, 15 from being pushed back.

Next, on the same principle as that of the second embodiment, the apparatus of FIG. 9 is intended to compensate for the return of the piston rod 14, 15 caused based on the compression of the hydraulic fluid generated by an intense push-back force FL' of the piston rod 14, 15 in the reversing step of the piston rod 14, 15.

As is obvious from the comparison between the structure of FIG. 9 and that of FIG. 5, in this embodiment, a pressure intensifying cylinder 2*b*' allows its pressure intensifying chamber 31*b*' to communicate with a rod-side cylinder chamber 62 of the working cylinder 1. Correspondingly, the pressure sensor 50, the switch control section 46, the pilot check valves 21 and 43, which are hydraulic circuit components, and the meter-in circuits (18, 19), (44, 45), and the switch valves 20 and 42 are provided to establish the reverse relationship with respective to the case of the second embodiment at the head side and the rod side.

Then, regarding the operation principle, this embodiment differs from the second embodiment in only the point that advancement of the pressure intensifying cylinder 2*b*' is performed in the reversing step of the piston rod 14, 15. The conditions relating to the pressure intensifying ratio K of the pressure-cylinder cylinder 2*b*' and the maximum discharge volume ΔV of the pressure intensifying chamber of the pressure intensifying cylinder 31*b*' are determined based on the position of the piston rod 14, 15 when the rated pressure Pp of the hydraulic pump 25 and the load are balanced with each other. The basic actuation procedure and function are simply the reverse of those of the second embodiment at the head side and the rod side.

With regard to the apparatus of the third embodiment (FIGS. 6 and 7), the pressure intensifying chamber of the pressure intensifying cylinder 2*a* is communicated with the rod-side cylinder chamber of the working cylinder 1, and the hydraulic circuit components are structured to establish the reverse relationship at the head side and the rod side. This makes it possible to move the pressure intensifying cylinder forward when the position detecting means 51 and 52 detect the known position where balance is held in the reversing step of the piston rod 14, 15. This also makes it possible to increase the pressure of the rod-side cylinder chamber that compensates for the compression quantity of the hydraulic fluid of the cylinder chamber based on the molding pressure of molten metal after the insertion and setting of the core 41.

As mentioned above, according to this embodiment, the same functions as those of the first to third embodiment are executed in the reversing step of the piston rod 14, 15. This is effective in not only the problem relating to the compression of the hydraulic fluid based on the molding pressure of molten metal after the insertion and setting of the core 41 but also the large load occurring at the time of pulling out the core 41 or detaching the mold.

Namely, a large force is needed to detach a solidified casting at an initial stage where the core 41 is pulled out and the like. When the use of the rated pressure of the hydraulic pump 25 cannot cope with such a case, a larger sized hydraulic cylinder must be used.

In other words, even though it is enough that a large pulling force may be supplied only for the purpose of a small amount of process for detaching the mold, the large sized hydraulic cylinder has to be used, and this causes a problem in which an extra space must be provided to the die cast machine.

With regard to this problem, according to the apparatus of this embodiment, it is easy to have such a structure that moves the pressure intensifying cylinders 2*b* and 2*b*' forward to supply an intense force at only the mold detaching time. This makes it possible to rationally solve the above-mentioned problem in addition to the use of the extremely small-sized pressure intensifying cylinders 2*b* and 2*b*'.

The pressure intensifying apparatus for the hydraulic cylinder of the present invention has the aforementioned structure and provides the following effects:

There is a problem in which the load applied to the rod is increased from the state where the piston rod is locked after the load applied to the rod is balanced with the advancing force occurring with the rated pressure of the hydraulic pump in the advancing step of the piston rod of the working cylinder. As a result, the hydraulic fluid of the head-side cylinder chamber is compressed so that the piston rod moves backward.

Regarding the above problem, the invention of the first embodiment allows the pressure intensifying cylinder to be automatically moved forward from the state where balance is held and to compensate for the compression quantity. This invention is adapted for use in the core pressing hydraulic cylinder in the die cast machine or the injection molding machine, whereby implementing the manufacture of casting products with high dimensional accuracy and no error.

The maximum discharge volume of the pressure intensifying chamber of the pressure intensifying cylinder additionally provided to the working cylinder may be one that is equivalent to the above-mentioned compression quantity, with the result that this invention can be structured by the extremely small-size cylinder. Accordingly, the space for additionally providing the pressure intensifying cylinder is little required and the pressure intensifying cylinder can be buried in the head of the working cylinder or the cylinder tube.

In the invention of the second embodiment, control for advancing the pressure intensifying cylinder and control for keeping the head-side cylinder chamber with a predetermined pressure are executed as detecting the pressure of the head-side cylinder chamber of the working cylinder by use of the pressure sensor, whereby implementing the same effect as that of the invention of the first embodiment.

Particularly, this invention eliminates the need for brining the maximum discharge volume of the pressure intensifying chamber of the pressure intensifying cylinder into correspondence with the specification of the individual working cylinders. This makes it possible to adapt the pressure intensifying cylinder to the various kinds of working cylinder after it is standardized under the condition of $\Delta V > \Delta Pa \times Va \times \beta$.

In the invention of the third embodiment, the advancing operation of the pressure intensifying cylinder is performed by the position detecting means for piston rod using the limit switch, the inductance sensor and the like, whereby implementing the same effect as that of the invention of the first embodiment.

The inventions of the second, third and fourth embodiments provide the apparatus which can obtain the same functions and effect as those of the inventions of the first, second, and third embodiments in the reversing step of the working cylinder, and which is effective at the core pulling-out time and the mold detaching time.

Various embodiments and changes may be made thereunto without departing from the broad spirit and scope of the invention. The above-described embodiments are intended to illustrate the present invention, not to limit the scope of the present invention. The scope of the present invention is shown by the attached claims rather than the embodiments. Various modifications made within the meaning of an equivalent of the claims of the invention and within the claims are to be regarded to be in the scope of the present invention.

What is claimed is:

1. A pressure intensifying apparatus for a hydraulic cylinder comprising:

a working cylinder;

a pressure intensifying cylinder for allowing a pressure intensifying chamber to communicate with a head-side cylinder chamber of said working cylinder;

a switching valve for controlling supply and discharge of a hydraulic fluid with respect to a head-side port and a rod-side port of said working cylinder;

a first pilot check valve which is disposed in a head-side supply and discharge circuit for connecting said head-side port of said working cylinder to said switching valve and whose pilot pressure is a pressure of a rod-side supply and discharge circuit for connecting said rod-side port of said working cylinder to said switching valve;

a check-valve equipped sequence valve which is disposed in a connection circuit for connecting a drive chamber side of said pressure intensifying cylinder to a portion of said head-side supply and discharge circuit closer to said switching valve than said first pilot check valve, and switches from a closed state to an open state with a rated pressure of a hydraulic pump for supplying said hydraulic fluid to said head-side supply and discharge circuit via said switching valve; and a second pilot check valve whose pilot pressure is said pressure of said rod-side supply and discharge circuit, said working cylinder, said pressure intensifying cylinder, said switching valve, said first pilot check valve, said check-valve equipped sequence valve and said second pilot check valve being connected in series in such a way as to satisfy $K>PLa/Pp$ where K is a pressure intensifying ratio of said pressure intensifying cylinder, Pp is said rated pressure of said hydraulic pump and PLa is a pressure in said head-side cylinder chamber when a maximum load occurring after Pp is balanced with a load acting on a piston rod of said working cylinder in a piston-rod advancing step of said working cylinder is applied, and $\Delta V=(PLa-Pp)\times Va\times\beta$ where $\Delta V$ is a maximum discharge volume of said pressure intensifying chamber of said pressure intensifying cylinder, Va is a volume of said head-side cylinder chamber when balance is held and $\beta$ is a compressibility of said hydraulic fluid.

2. A pressure intensifying apparatus for a hydraulic cylinder comprising:

a working cylinder;

a pressure intensifying cylinder for allowing a pressure intensifying chamber to communicate with a rod-side cylinder chamber of said working cylinder;

a switching valve for controlling supply and discharge of a hydraulic fluid with respect to a head-side port and a rod-side port of said working cylinder;

a first pilot check valve which is disposed in a rod-side supply and discharge circuit for connecting said rod-side port of said working cylinder to said switching valve and whose pilot pressure is a pressure of a head-side supply and discharge circuit for connecting said head-side port of said working cylinder to said switching valve;

a check-valve equipped sequence valve which is disposed in a connection circuit for connecting a drive chamber side of said pressure intensifying cylinder to a portion of said rod-side supply and discharge circuit closer to said switching valve than said first pilot check valve, and switches from a closed state to an open state with a rated pressure of a hydraulic pump for supplying said hydraulic fluid to said rod-side supply and discharge circuit via said switching valve; and a second pilot check valve whose pilot pressure is said pressure of said head-side supply and discharge circuit, said working cylinder, said pressure intensifying cylinder, said switching valve, said first pilot check valve, said check-valve equipped sequence valve and said second pilot check valve being connected in series in such a way as to satisfy $K>PLb/Pp$ where K is a pressure intensifying ratio of said pressure intensifying cylinder, Pp is said rated pressure of said hydraulic pump and PLb is a pressure in said rod-side cylinder chamber when a maximum load occurring after Pp is balanced with a load acting on a piston rod of said working cylinder in a piston-rod reversing step of said working cylinder is applied, and $\Delta V=(PLb-Pp)\times Vb\times\beta$ where $\Delta V$ is a maximum discharge volume of said pressure intensifying chamber of said pressure intensifying cylinder, Vb is a volume of said rod-side cylinder chamber when balance is held and $\beta$ is a compressibility of said hydraulic fluid.

3. A pressure intensifying apparatus for a hydraulic cylinder comprising:

a working cylinder;

a pressure intensifying cylinder for allowing a pressure intensifying chamber to communicate with a head-side cylinder chamber of said working cylinder;

a switching valve for controlling supply and discharge of a hydraulic fluid with respect to a head-side port and a rod-side port of said working cylinder;

a pilot check valve which is disposed in a head-side supply and discharge circuit for connecting said head-side port of said working cylinder to said switching valve and whose pilot pressure is a pressure of a rod-side supply and discharge circuit for connecting said rod-side port of said working cylinder to said switching valve;

a pressure sensor for detecting a pressure in said head-side cylinder chamber of said working cylinder; and pressure intensification control means for controlling supply and discharge of said hydraulic fluid to and from a drive chamber of said pressure intensifying cylinder using a detection signal from said pressure sensor in a piston-rod advancing step of said working cylinder, wherein $K>PLa/Pp$ is satisfied where K is a pressure intensifying ratio of said pressure intensifying cylinder, Pp is a rated pressure of a hydraulic pump and PLa is a pressure in said head-side cylinder chamber when a maximum load occurring after Pp is balanced with a load acting on a piston rod of said working cylinder in a piston-rod advancing step of said working cylinder is applied, and $\Delta V\geqq(PLa-Pp)\times Va\times\beta$ where $\Delta V$ is a maximum discharge volume of said pressure intensifying chamber of said pressure intensifying cylinder, Va is a volume of said head-side cylinder chamber when balance is held and $\beta$ is a compressibility of said hydraulic fluid, and said pressure intensification control means supplies said hydraulic fluid to said drive chamber of said pressure intensifying cylinder when $Sr>Ss\geqq Sp$ where Ss is a level of said detection signal from said pressure sensor, Sp is a level of an output signal corresponding to Pp and Sr is a level of an output signal corresponding to PLa, and discharges said hydraulic fluid from said drive chamber of said pressure intensifying cylinder when $Ss>Sr$.

4. A pressure intensifying apparatus for a hydraulic cylinder comprising:

a working cylinder;

a pressure intensifying cylinder for allowing a pressure intensifying chamber to communicate with a rod-side cylinder chamber of said working cylinder;

a switching valve for controlling supply and discharge of a hydraulic fluid with respect to a head-side port and a rod-side port of said working cylinder;

a pilot check valve which is disposed in a rod-side supply and discharge circuit for connecting said rod-side port of said working cylinder to said switching valve and whose pilot pressure is a pressure of a head-side supply and discharge circuit for connecting said head-side port of said working cylinder to said switching valve;

a pressure sensor for detecting a pressure in said rod-side cylinder chamber of said working cylinder; and pressure intensification control means for controlling supply and discharge of said hydraulic fluid to and from a drive chamber of said pressure intensifying cylinder using a detection signal from said pressure sensor in a piston-rod reversing step of said working cylinder, wherein $K>PLb/Pp$ is satisfied where K is a pressure intensifying ratio of said pressure intensifying cylinder, Pp is a rated pressure of a hydraulic pump and PLb is a pressure in said rod-side cylinder chamber when a maximum load occurring after Pp is balanced with a load acting on a piston rod of said working cylinder in a piston-rod reversing step of said working cylinder is applied, and $\Delta V>(PLb-Pp)\times Vb\times\beta$ where $\Delta V$ is a maximum discharge volume of said pressure intensifying chamber of said pressure intensifying cylinder, Vb is a volume of said rod-side cylinder chamber when balance is held and $\beta$ is a compressibility of said hydraulic fluid, and said pressure intensification control means supplies said hydraulic fluid to said drive chamber of said pressure intensifying cylinder when $Sr>Ss\geqq Sp$ where Ss is a level of said detection signal from said pressure sensor, Sp is a level of an output signal corresponding to Pp and Sr is a level of an output signal corresponding to PLb, and discharges said hydraulic fluid from said drive chamber of said pressure intensifying cylinder when $Ss>Sr$.

5. A pressure intensifying apparatus for a hydraulic cylinder comprising:

a working cylinder;

a pressure intensifying cylinder for allowing a pressure intensifying chamber to communicate with a head-side cylinder chamber of said working cylinder;

a switching valve for controlling supply and discharge of a hydraulic fluid with respect to a head-side port and a rod-side port of said working cylinder;

a pilot check valve which is disposed in a head-side supply and discharge circuit for connecting said head-side port of said working cylinder to said switching valve and whose pilot pressure is a pressure of a rod-side supply and discharge circuit for connecting said rod-side port of said working cylinder to said switching valve;

position detection means for detecting when a piston rod of said working cylinder reaches a known position of said piston rod where a rated pressure of a hydraulic pump is balanced with a load acting on said piston rod of said working cylinder in a piston-rod advancing step of said working cylinder; and pressure intensification control means for starting supplying said hydraulic fluid to a drive chamber of said pressure intensifying cylinder based on a detection signal from said position detection means in said piston-rod advancing step of said working cylinder, wherein $K>PLa/Pp$ is satisfied where K is a pressure intensifying ratio of said pressure intensifying cylinder, Pp is said rated pressure of said hydraulic pump and PLa is a pressure in said head-side cylinder chamber when a maximum load occurring after said position detection means makes that detection is applied, and $\Delta V=(PLa-Pp)\times Va\times\beta$ where $\Delta V$ is a maximum discharge volume of said pressure intensifying chamber of said pressure intensifying cylinder, Va is a volume of said head-side cylinder chamber when said position detection means makes said detection and $\beta$ is a compressibility of said hydraulic fluid.

* * * * *